US007775911B2

(12) United States Patent
Zappel et al.

(10) Patent No.: US 7,775,911 B2
(45) Date of Patent: Aug. 17, 2010

(54) APPARATUS AND METHOD FOR TRAINING PLAYERS IN SPORTS

(76) Inventors: Joseph Zappel, 8861 Berta Ridge Ct., Salinas, CA (US) 93907; Robert Potenza, 1025 Foster City Blvd., #A, Foster City, CA (US) 94404

( * ) Notice: Subject to any disclaimer, the term of this patent is extended or adjusted under 35 U.S.C. 154(b) by 37 days.

(21) Appl. No.: 11/678,160

(22) Filed: Feb. 23, 2007

(65) Prior Publication Data

US 2007/0202968 A1 Aug. 30, 2007

Related U.S. Application Data

(60) Provisional application No. 60/776,298, filed on Feb. 24, 2006.

(51) Int. Cl.
*A63B 69/00* (2006.01)

(52) U.S. Cl. ..... 473/422; 473/457; 473/453; 473/458

(58) Field of Classification Search ..... 473/422–425, 473/427, 615, 451, 453, 457, 458, 450, 464; 119/738, 769, 791, 770, 707, 708, 795; 273/317.8, 273/329, 332, 334, 335
See application file for complete search history.

(56) References Cited

U.S. PATENT DOCUMENTS 2,765,170 A 10/1956 Brown
2,942,883 A 6/1960 Moore
3,039,228 A * 6/1962 Mazzadra ..... 446/266
3,114,546 A 12/1963 Verseghy
3,531,115 A * 9/1970 Alexander ..... 473/424
3,907,287 A 9/1975 Fox et al.
4,022,467 A 5/1977 Ruess
4,042,237 A * 8/1977 Moraru ..... 473/429
4,415,155 A 11/1983 Goudreau et al.
4,417,730 A * 11/1983 Weiner ..... 473/426
4,460,172 A * 7/1984 Hogan ..... 473/426
4,513,965 A 4/1985 Aschermann
4,784,389 A 11/1988 Taylor
4,846,472 A 7/1989 Terza
4,964,634 A 10/1990 Boyer
5,452,888 A 9/1995 Glenn
5,492,321 A 2/1996 Cipriano (Continued)

OTHER PUBLICATIONS

U.S. Appl. No. 10/922,784, Joel Grubman (pending appln, RCE filed Sep. 12, 2007).

(Continued)

*Primary Examiner*—Mitra Aryanpour

(57) ABSTRACT

A ball-like target, which may be an actual ball used in playing a sport to be taught, for example in teaching batting to trainees, is attached to a rod, so that the trainer can precisely control the target's speed and attitude of the target during the entire course of presentation to a trainee. On the one hand, the target, rod and connecting mechanism are rigidly interconnected so that the trainer has complete control over the speed and trajectory of the presentation of the target. But on the other hand, the construction is such that the apparatus may be repeatedly struck by the trainee's bat at any speed, from slow to "full swing-away" without any substantial damage to the apparatus. In this manner the trainee can be quickly taught the eye-hand coordination and other skills needed to become an accomplished hitter.

4 Claims, 9 Drawing Sheets

U.S. PATENT DOCUMENTS

| | | | | |
|---|---|---|---|---|
| 6,004,212 | A | 12/1999 | Smirnov | |
| 6,390,939 | B1 * | 5/2002 | Palacios | 473/422 |
| 6,435,989 | B1 | 8/2002 | Grubman | |
| 2006/0014597 | A1 * | 1/2006 | Cantu et al. | 473/422 |

OTHER PUBLICATIONS

Nedco Sports Products, Inc., "Hit2win Trainer The Next Generation Handheld Trainer Drills Instruction Manual", 1 page, 2005.
Hit2win.com, Welcome homepage, 2 pages, Mar. 11, 2002.

* cited by examiner

APPARATUS AND METHOD FOR TRAINING PLAYERS IN SPORTS

CROSS-REFERENCE TO RELATED DOCUMENTS

The present patent application claims the benefit of U.S. Provisional Application Ser. No. 60/776,298 filed on Feb. 24, 2006. The prior application is incorporated herein in its entirety by reference.

BACKGROUND OF THE INVENTION

1. Field of the Invention

The present invention is a device for providing a unique form of training for those desiring to learn the art of hitting, in sports such as baseball. The invention provides a ball suitable for the sport to be learned attached to a handle which allows a trainer to controllably present the ball to a trainee in a manner realistic for the sport and the degree of skill of the trainee. The invention will be best understood by reference to the following discussion and the associated figures.

2. Description of Related Art

In U.S. Pat. No. 6,435,989 there is described a training device for teaching young people how to hit a ball in a sport, such as baseball. In a preferred embodiment in that patent an actual baseball is connected via a connecting nut and bolt arrangement to the end of a rod, the other end of which is held by the trainer. In essence the ball is then completely under the full control of the trainer who, acting as a pitcher, can control the ball's speed and attitude of presentation to the trainee, acting as a batter. The advantages of this arrangement over conventional training devices are set out in U.S. Pat. No. 6,435,989. In particular that patent describes the typical situation encountered by a new trainee to a ball-sport, in which the trainer would toss the ball to the trainee and issue verbal instructions such as "swing" or "keep your eye on the ball". To a new student, the proper way to execute these instructions would not be immediately clear and a long, iterative process would ensue. Typical methods of presenting a ball to a trainee include hanging a ball by a string, placing a ball on a support, or ejecting a ball from a machine. Some trainees may master these instructions quickly but in the vast majority of cases the learning process continues for an extended period, occasionally extending to months or more to achieve acceptable mastery.

U.S. Pat. No. 6,435,989 discloses a device with a ball, representative of the ball to be used in actually playing the sport being taught, attached to a handle apparatus that allows the trainer, acting as a pitcher, to control the ball's speed and attitude of presentation to the trainee, acting as a batter. The trainer can then explain in whatever detail is necessary for the trainee to understand the instructions being provided and the trainee can respond accordingly. This provides the trainee with instructions and practice at a speed commensurate with his or her ability, allowing the trainee to more quickly grasp the lesson being presented. The ultimate results for the trainee are improved eye-hand coordination, many practice swings at an actual ball per unit time, immediate feed back on the result of each swing, and improved self-confidence as more and more contact is made by the bat with the ball, especially in young ball players.

It can be seen from the description of the Best Mode of the Invention in U.S. Pat. No. 6,435,989 that the device was intended to be used in a mode in which the trainee (the hitter) would ordinarily swing in a relatively slow motion, so that the details of the swing and contact with the ball could be followed and discussed between the trainer and the trainee at the very same time that the swing was occurring. However as the device was used by increasing numbers of trainees, it became apparent that in the presence of an actual baseball in the strike zone of the batter often, "the temptation was too much" and the batter would take a full swing at the ball. However, if the bat does not make clean contact with the ball, it was found that use of the product in the "swing-away" mode could have deleterious effects on the device. Sometimes the rod would be nicked and could ultimately be disfigured from too many nicks. Additionally, if a particularly fast swing made contact with the ball and the rod at the same time (as in an undercut swing that was off-target) then it was found that the bolt connecting the ball to the rod could be bent.

BRIEF DISCLOSURE OF THE INVENTION

The present invention provides a ball, representative of the ball to be used in actually playing the sport being taught, attached to a handle apparatus that allows the trainer, acting as a pitcher, to control the ball's speed and attitude of presentation to the trainee, acting as a batter. The trainer can then explain in whatever detail is necessary for the trainee to understand the instructions being provided and the trainee can respond accordingly.

The device is constructed in such manner that the ball may be presented at varying speeds, and the trainee may swing at the ball at any speed from slow motion up to full "swing-away", without causing any substantial damage to the device. This provides the trainee with instructions and practice at varying speeds commensurate with his or her ability, allowing the trainee to more quickly grasp the lesson being presented. The ultimate results for the trainee are improved eye-hand coordination, many practice swings at an actual ball per unit time, immediate feed back on the result of each swing, and improved self-confidence as more and more contact is made by the bat with the ball, especially in young ball players. In point of fact, we have found that the present invention can be used in a mode in which the trainee develops what is called "muscle memory" of the correct motions for hitting. This is neuro-muscular training, in which the trainer instructs the batter to initially swing the bat in slow motion, the trainer correcting the batter's stance and motion with each presentation of the ball and concomitant swing. As the training progresses, the trainer presents the ball at increasing speeds, and the hitter can also increase the speed of his swings, until finally swinging-away at the ball in the manner of a big-league hitter. Thus does the batter progress from novice to full-fledged Little League hitter in a very short time.

Another benefit of the present invention is that the device can be used with experienced hitters who may be experiencing a batting slump. The batter in a slump can engage a trainer, and using the invention, can return to the slow-motion swing mode to work out problems with his or her swing, stance etc. Then the trainer and the batter can increase the speed of presentation of the ball, and the hitting speed, allowing the batter to return to full hitting capacity in a short time, perhaps even in a single session.

Other features of the present invention are disclosed or apparent in the section entitled "Detailed Description of the Invention".

DETAILED DESCRIPTION OF THE INVENTION

Figure 1:
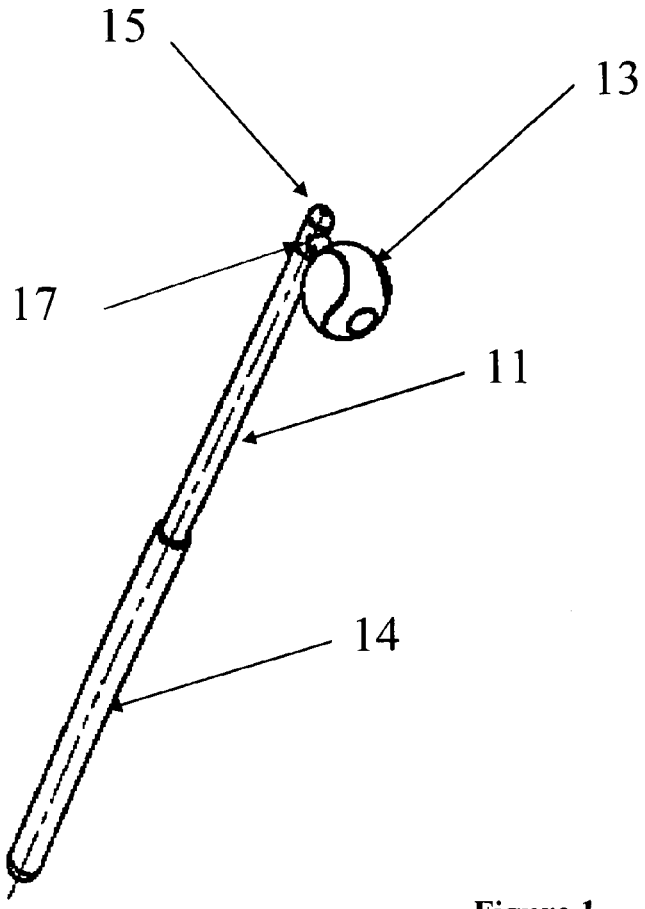
FIG. 1 shows a view of an assembled device in accordance with aspects of the invention.

The present invention is illustrated in FIG. 1. Apparatus 100 is formed of a substantially rigid rod, or shaft 11 of preferably round cross section having a handle 14 at one end and a ball 13 attached at the other end. Rod 11 can be composed of any material which is sufficiently sturdy to withstand multiple impacts from another object such as a baseball bat. Rod 11 is of a convenient length between 30 inches and 48 inches, preferably 34-36 inches. Rod 11 may be of any convenient diameter suitable to the material of construction to allow strength yet remain light enough for the trainer to repeatedly move and hold the ball 13 out in an extended position.

In a preferred embodiment rod 11 is fabricated from hollow aluminum tubing with a diameter of 1.0 inches. Rod 11 should not exceed 2 inches in diameter to preclude it obscuring ball 13 or distracting the trainee when apparatus 100 is in use. Rod 11 may also be fabricated of wood, metal or polymeric composite, or hollow metal tubing, or other material which will withstand multiple impacts from a hitting instrument such as a baseball bat. Apparatus 100, should weigh between 1 and 4 pounds, preferably approximately 2 pounds so that it may be held at handle 14 and moved at various speeds to the trainee by a man or woman of average strength.

FIG. 1 also shows handle 14, which may be composed of any resilient material placed on rod 11 as is known in the art for enhancing the gripping surface. An effective material is vinyl. Handle 14 preferentially extends for approximately 18 inches along the length of rod 11, but may be longer or shorter if desired.

At the end of rod 11 opposite handle 14 a "hitting target", which will usually be a type of ball 13, is attached. Ball 13 should be of similar size, shape, and feel as an actual ball used in the sport for which the invention will provide practice. For example, if apparatus 100 is used to instruct for conventional baseball ("hardball"), ball 13 should closely approximate a standard baseball as used in that sport. If the invention is to be used to instruct for "softball", then ball 13 should closely resemble a softball as used in that sport. Other batting sports such as cricket would require a ball representative of that sport. In the preferred embodiment, actual hard and soft balls from the sport are modified and attached to apparatus 100 as described below. A ball as used in a sport will sometimes be referred to herein as an "actual sport-ball". An actual sport-ball that has been modified, for example by having a hole drilled therethrough, may sometimes be referred to as a "modified actual sport-ball", where the word "sport" may be "baseball", "hardball", "softball", "cricket" and so forth.

Into the end of rod 11 there is inserted a cap 15 that seals off the rod. A connecting mechanism 17 connects rod 11 to ball 13 in such a manner that neither the connecting mechanism nor the device as a whole will be damaged during training, even if a trainee "swings away" thereby striking the device with great force. And this is still the case whether the trainee strikes ball 13 alone, or mis-hits and strikes either the ball 13 and a portion of rod 11 and/or connecting mechanism 17, or even misses the ball entirely, the full force thereby hitting rod 11 and/or connecting mechanism 17.

Figure 2A:
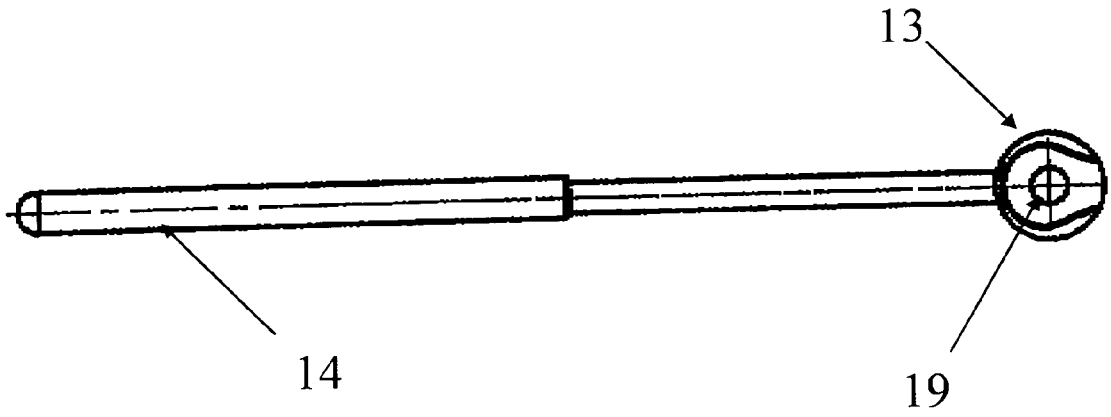
FIGS. 2*a*, 2*b*, and 2*c* show bottom view, side view, and end view, respectively, of the device shown in FIG. 1.
Figure 2B:
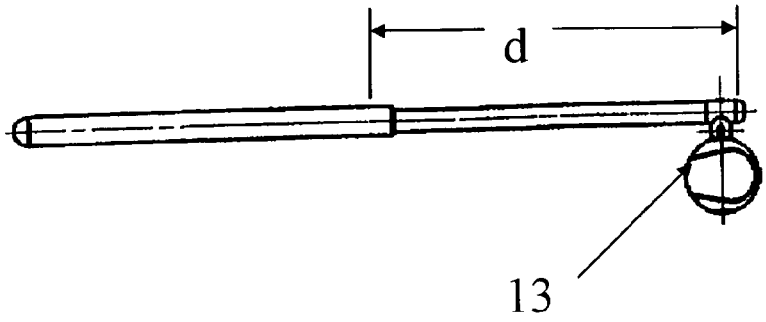
Figure 2C:
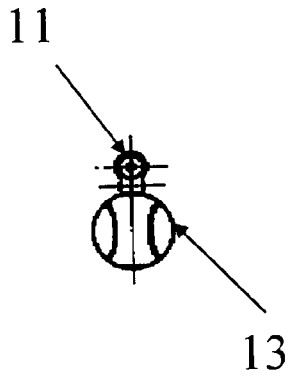

FIGS. 2*a*, 2*b*, and 2*c* show bottom view, side view, and end view, respectively of a preferred embodiment of the invention. FIG. 2*a* shows the bottom of ball 13, including a ball-cap 19 whose function will be described more fully below. FIG. 2*b* illustrates the preferred positioning of ball 13 with respect to the length of rod 11, showing that the outer perimeter of ball 13 preferably extends a small distance beyond the end of rod 11, about 0.7 inches in the case of a baseball and 1.0 inches in the case of a size 11" softball. In the preferred embodiment, rod 11 as well as connecting mechanism 17 are preferably coated with a rubber-like material which maintains its cosmetic appearance even when subjected to the substantial force of a hitting device, such as a baseball bat which has been swung at high speed by a trainee. A material such as polyurethane, which is applied via dipping or spraying as is known in the relevant art has proven to be effective. FIG. 2*c* indicates that the coating should preferably extend down rod 11 from the end wherein is attached ball 13, to terminate a short distance beneath handle 14, one inch being a preferred distance. The coating is preferably of a dark color such as black, to minimize the visual distraction of the rod to the trainee. In other words, the goal is that the vision of the trainee should be fully focused upon the ball, and the motion of that ball as it is presented; it should appear as much as possible as would a normally-pitched ball approaching in the air. FIGS. 2*a*, 2*b*, and 2*c* also show the preferred positioning of the stitching of ball 13 with respect to a hole along the central axis of the ball into which a "ball-cap" 19 is placed. FIG. 2 shows in detail that the central axis terminating in ball-cap 19 is positioned symmetrically between the stitching on the ball, and does not intersect the stitching at any point.

Figure 3:
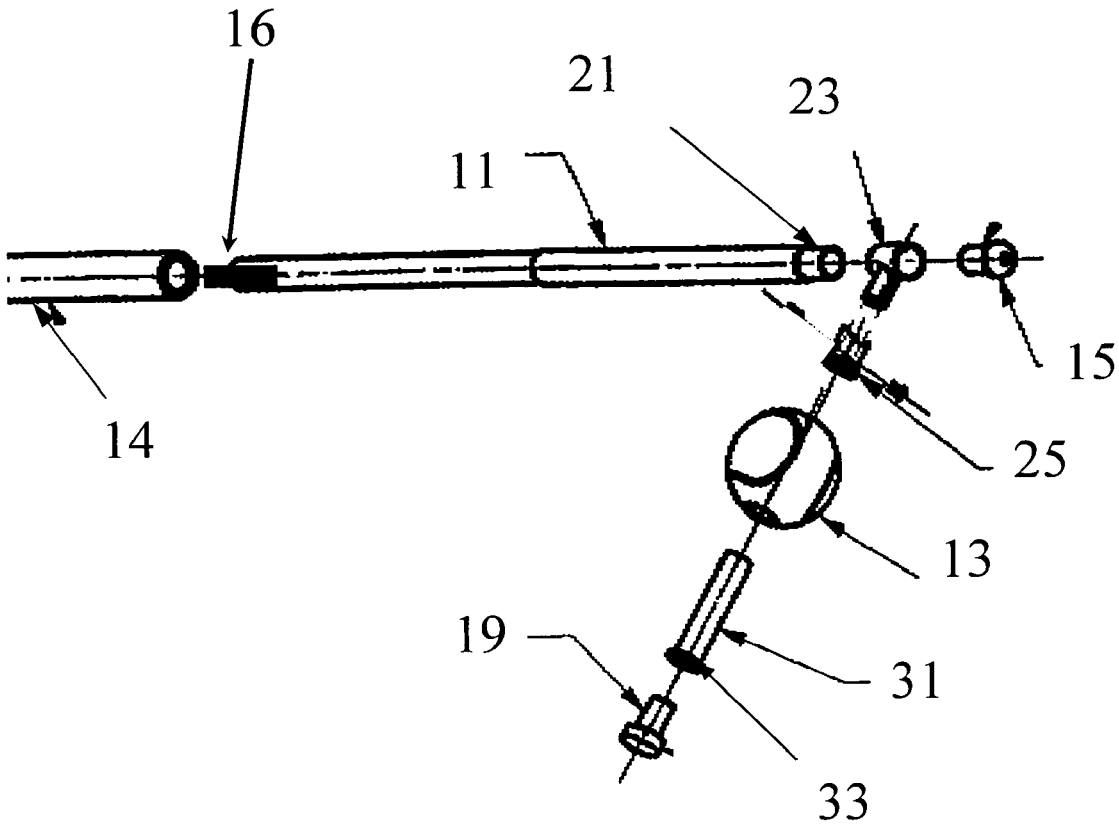
FIG. 3 shows an exploded view of the device shown in FIG. 1.

Referring now to FIG. 3, there is shown a blown-apart view of a preferred embodiment of the invention, including rod 11 and handle 14, which is shown in a position having been slipped off the end of rod 11. A counterweight 16 is inserted into the end of rod 11 at the position shown, preferably by a press-fit to prevent motion. Details of the counterweight are shown and discussed later, in connection with FIG. 11. A sleeve 23 of length 1.5 inches (shown in more detail below) fits the end of shaft 11. After the sleeve is inserted onto shaft 11, cap 15 is inserted into the end of rod 11. A collar 25 slips onto a perpendicularly extending neck 24 of sleeve 23, the other end of collar 25 being positioned as a "top-cap" to ball 13. To complete the assembly a rod 31 is inserted into the bottom of ball 13, terminating in a circular ridge 33, extending about 0.185 inch in radius beyond the outer wall of rod 31. Finally, a cap 19 is inserted behind rod 31. Details of all of these components and their assembly together will be described more fully below in connection with later Figures.

Figure 4A:
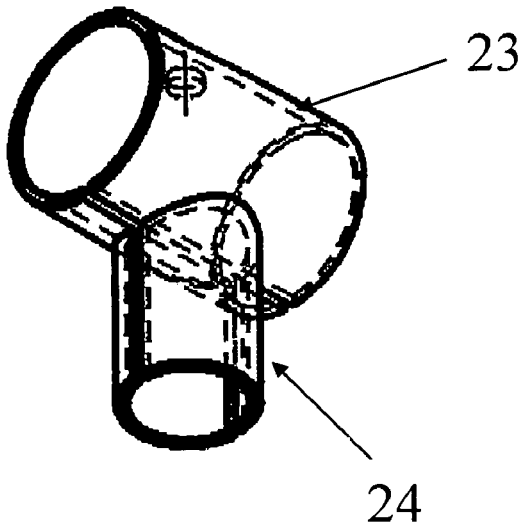
FIGS. 4*a* and 4*b* show two views of a sleeve utilized in the invention.
Figure 4B:
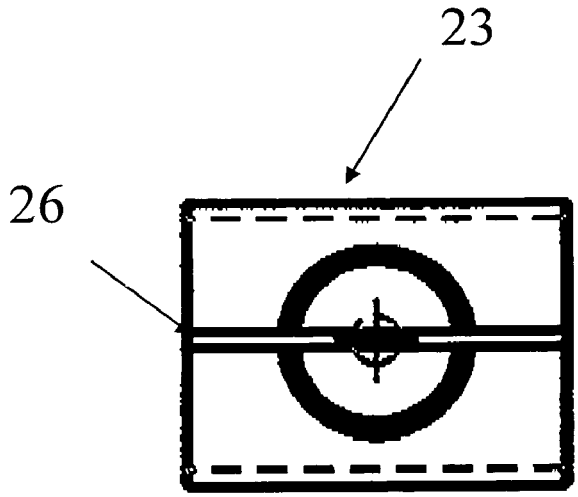

FIG. 4*a* shows sleeve 23 in more detail, including a section 24 that extends perpendicularly to shaft 11. FIG. 4*b* shows a bottom view of sleeve 23 which includes a longitudinal slit 26 that facilitates the insertion of sleeve 23 onto ridge 21 of shaft 11.

Figure 5:
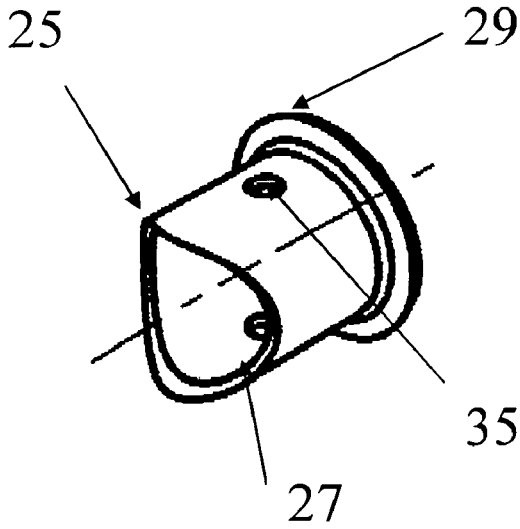
FIG. 5 shows a collar utilized in the invention.

FIG. 5 shows that the top portion of collar 25 is shaped in a curve 27 so as to mate with the underside of sleeve 23 in a seamless manner. The end of collar 25 opposite curve 27 is terminated in a circular ridge 29, extending about 0.16 inch in radius beyond the outer wall of collar 25. Collar 25 includes a hole 35 across the main diameter, which will accommodate a rivet to be shown in a later Figure.

Figure 6:
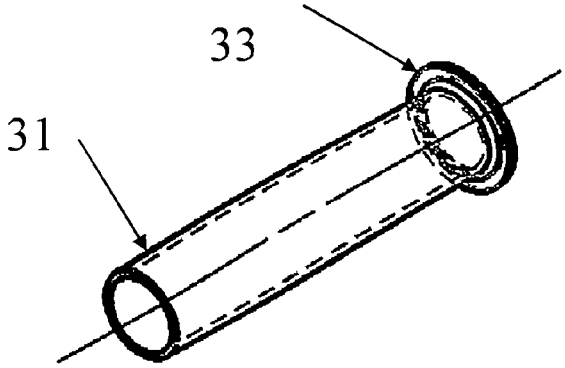
FIG. 6 shows a rod utilized in the invention.

FIG. 6 shows a rod 31, preferably a hollow metallic cylinder that is inserted into ball 13 from the end of the ball furthest from rod 11, until seating of ridge 35 against a corresponding ridge 41 (in FIG. 7) inside ball 13. Rod 31 is preferably constructed of 16 gage wall seamless mechanical steel tubing, with length of 2.8 in for hardball and 3.8 in for softball, and diameter about 0.88 inches. While some deviation from these parameters is acceptable (for example in the case in which ball 13 is a softball (rather than a baseball), the diameter of rod 31 can be enlarged without changing the ratio of the diameter of the inserted rod to the diameter of the ball in which the rod is positioned). In general, the diameter should be as small as possible to minimize weight and space, but must be sufficiently large so that when the device is struck by a hitting device, such as a baseball bat, the blow will be absorbed without damage to the training device, even if the blow partially misses the ball. Rod or hollow cylinder 31 has a diameter greater than 0.25 times the diameter of said ball-like object and more preferably the rod or hollow cylinder 31 has a diameter greater than 0.20 times the diameter of said ball-like object.

Figure 7:
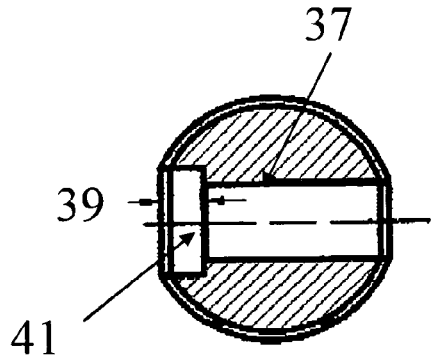
FIG. 7 shows cross-sectional view of a ball in accordance with an aspect of the invention.

In FIG. 7 there is shown a ball 13 used in a sport, which in a preferred embodiment may be a baseball, softball, tennis ball, racquet ball or ball appropriate for another sport. In the preferred embodiment of FIG. 7, the particular ball illustrated is a baseball, conventionally also known as a "hardball". Hardball 13 may be any of the hardballs commonly available at sporting goods outlets, or in quantity from the suppliers of these. The diameter of a standard hardball is 2.9 inches. As shown in FIG. 7, ball 13 is drilled out along a diameter, such that the diameter of the resulting cylindrical slot 37 extending through the ball is just sufficient to allow rod 31 to be inserted through slot 37. For the exemplary diameter of rod 31 described above, the diameter of slot 37 would be 0.875 inches. At one end of slot 37 there is drilled a larger slot 39, whose diameter is about 0.05 inches larger than the diameter of ridge 33 on rod 31. Slot 39 extends into the ball a distance of about 0.5 inches. The top of slot 39 serves as a ledge or "stop" 41 for rod 31, in that when rod 31 in inserted through slot 37, ridge 33 will come to rest against ledge 41, preventing the further insertion of rod 31 into slot 37.

Figure 8:
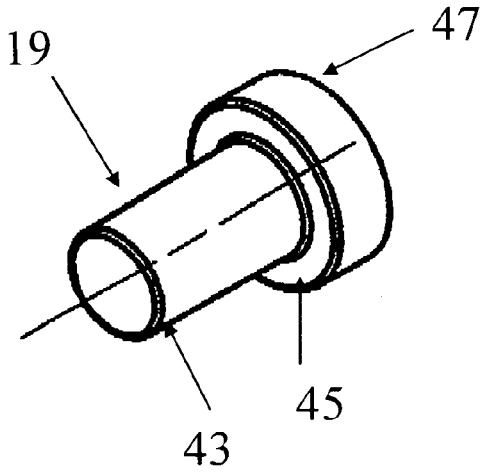
FIG. 8 shows a cap which is inserted into a ball in accordance with some aspects of the invention.

FIG. 8 shows some detail of ball-cap 19, which is preferably a molded element of a material such as urethane rubber. Cap 19 includes a shaft portion 43 of length about 1.0 and diameter about 0.75. Cap 19 is inserted into ball 13 after the insertion and seating of rod 31. Hence shaft 43 is inserted into the hollow center of rod 31 until a ridge 45 of cap 19 encounters ridge 33 of rod 31, which "stop" positions ball-cap 19. The top portion 47 of cap 19 is molded with a radius conforming to the radius of ball 13, so that when the ball-cap is inserted into the ball, the surface of the ball-cap appears to be just a portion of the surface of the ball itself. Hence the trainee does not see any protrusions or other elements at the bottom of the ball, so that the object being viewed and hit by the trainee is very close to the actual ball that the Trainee will encounter when playing in an actual game.

Figure 9:
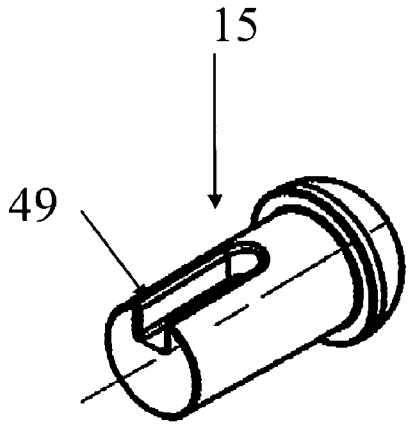
FIG. 9 shows a cap which is inserted into a rod in accordance with some aspects of the invention.

FIG. 9 shows some detail of cap 15 that is inserted into the end of rod 11. The diameter of cap 15 is about 0.84 allowing cap 15 to be inserted into the hollow center of rod 11. Also shown is a slot 49 whose function is to accept the end of a rivet used to connect sleeve 23 to rod 11, as will be described below.

Figure 10:
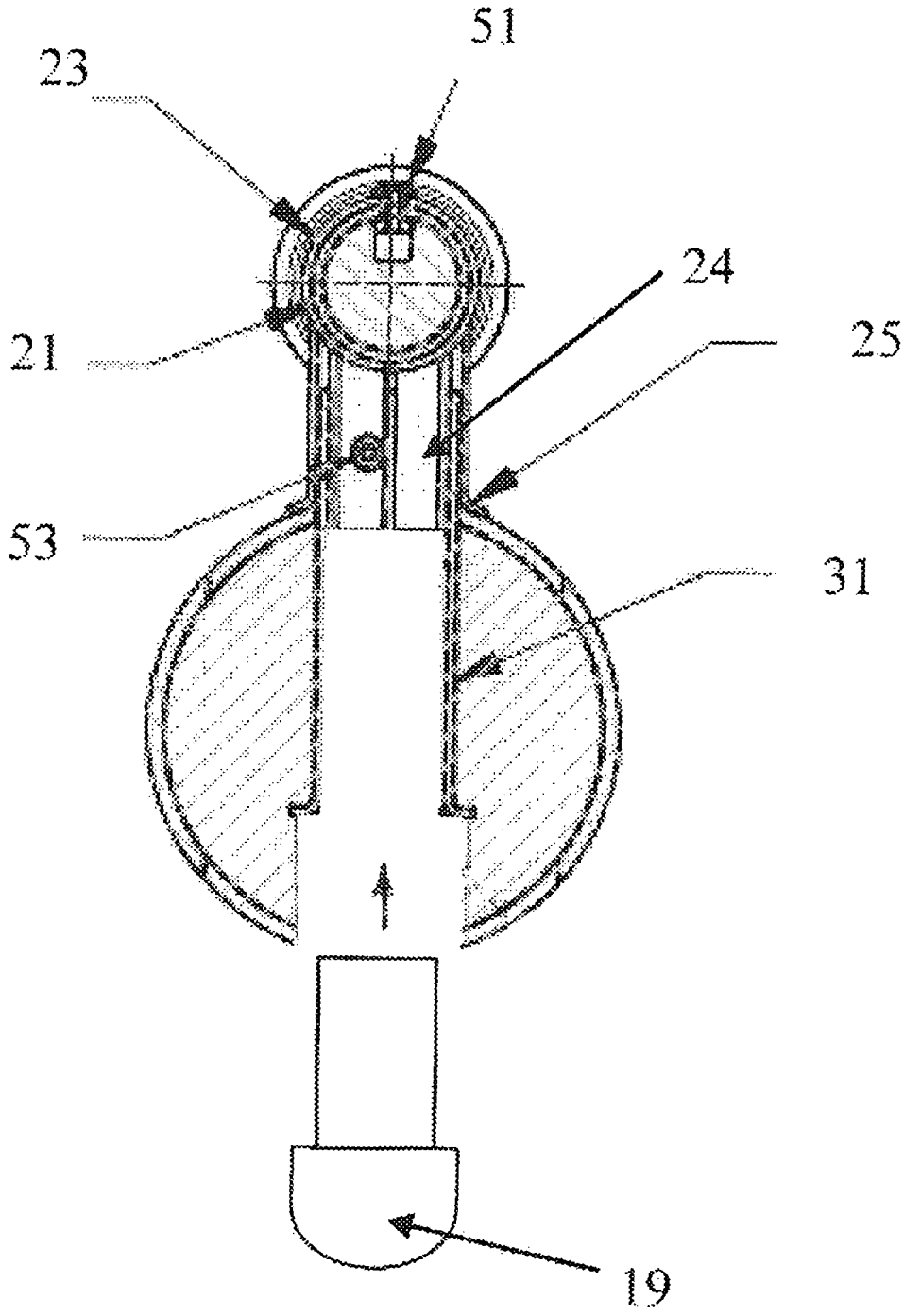
FIG. 10 is a cross-sectional view showing the assembly of some parts in accordance with aspects of the invention.

FIG. 10 shows how some of the components of the invention are interconnected and held in place in accordance with a preferred embodiment. The view is a cross-section through the apparatus that slices ball 13 in half, vertically. At the top is shown ridge 21 at the end of rod 11. Surrounding ridge 21 is sleeve 23 having its perpendicularly extending neck 24 extending downward into the core of ball 13. Rod 31 has been inserted into ball 13 from the bottom, extending out through the top of the ball to contact the bottom of sleeve 23. Collar 25 surrounds neck 24. A first rivet 51 fastens together rod 11 and sleeve 23. (The bottom of rivet 51 is seated in slot 49 of end-cap 15 which is inserted into the end of rod 11). A second rivet 53 is inserted laterally through collar 25, rod 31, and neck 24, thereby fastening together these elements in locked position relative one to another. Ball cap 19 is inserted into rod 31 as described above. The two caps are held in place inside their associated tubes by means of a strong fastening glue.

Figure 11:
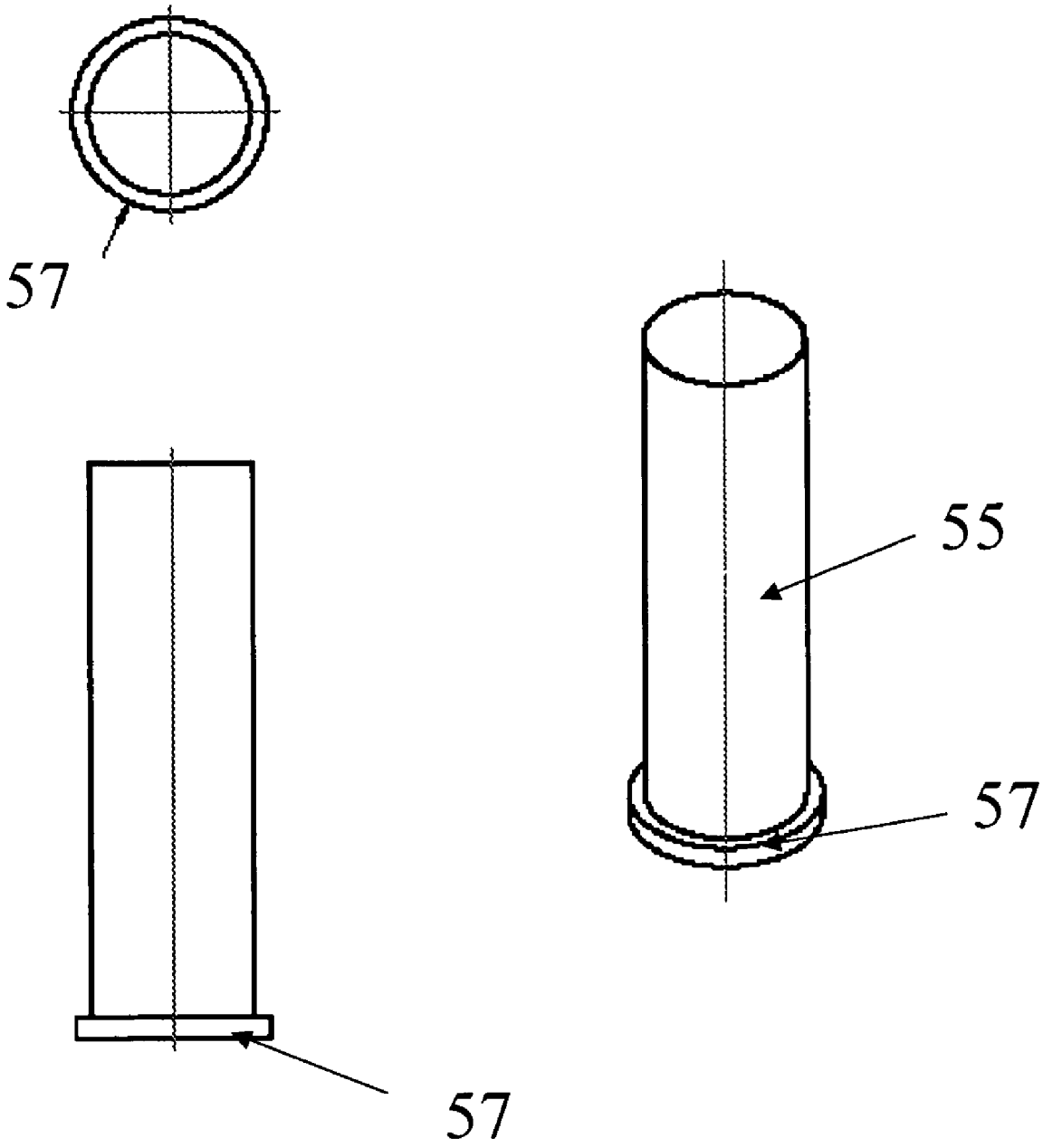
FIG. 11 shows three views of a counter-weight utilized in accordance with aspects of the invention.

In FIG. 11 there is shown a counterweight 55, which in a preferred embodiment is a lead casting whose outer diameter is selected to be a press-fit into the end of rod 11. A ridge 57, whose diameter is equal to that of the outer diameter of rod 11, prevents counterweight 55 from further insertion into shaft 11. Counterweight 55 acts to counterbalance the torque generated by the weight of ball 13 and the ball-attachment apparatus near the end of rod 11. In a preferred embodiment in which ball 13 is a hardball, the counterweight is of diameter 0.83 inches and length of 3 inches with a total weight of about 11 ounces. This configuration gives a balance point of the device located about 15.5 inches from the end of the handle, and 18.5 inches from the end of the rod nearest the ball. Surprisingly, almost all users report that a device including the additional counter-weight actually "feels lighter" than the same device without the additional weight. This can be important when a single trainer intends to work with the device for an extended period of time. In a trade-off of weight and balance, a different material can be substituted for lead. For example, if a similarly shaped weight of steel is used, the overall weight of the device is reduced by about 10 ounces, while the balance point is shifted about 1.5 inches away from the trainer.

In another embodiment of the invention, the ball is connected to the rod in a manner in which the plug fitting into the ball is eliminated. This provides an improved cosmetic, in that the target for the trainee is now exactly the same target that the trainee will encounter in playing the actual sport; thus for the sport of baseball, the ball is now an exact and externally intact baseball, and similarly for the sport of softball. No plug is required in either case.

Figure 11A:
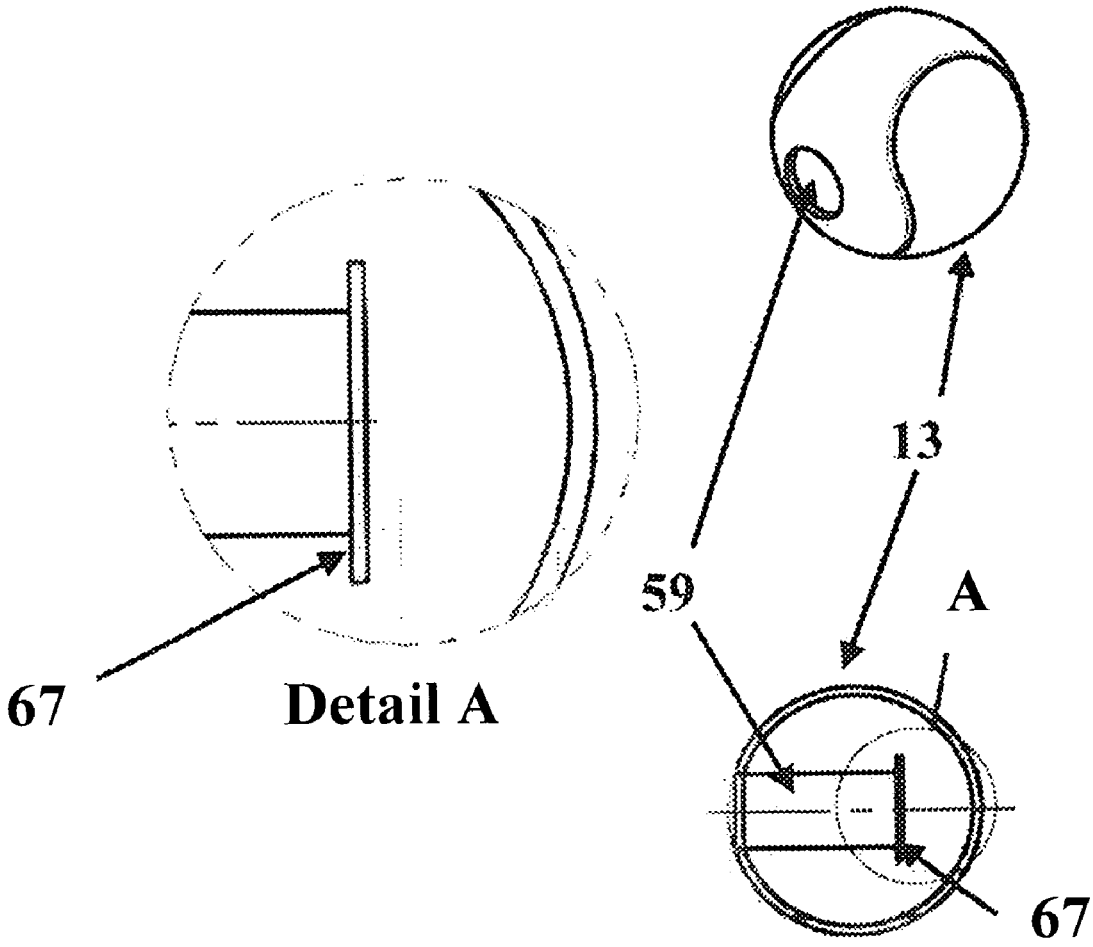
FIG. 11*a* shows in cross section, the interior of a ball in accordance with aspects of the invention.
Figure 11B:
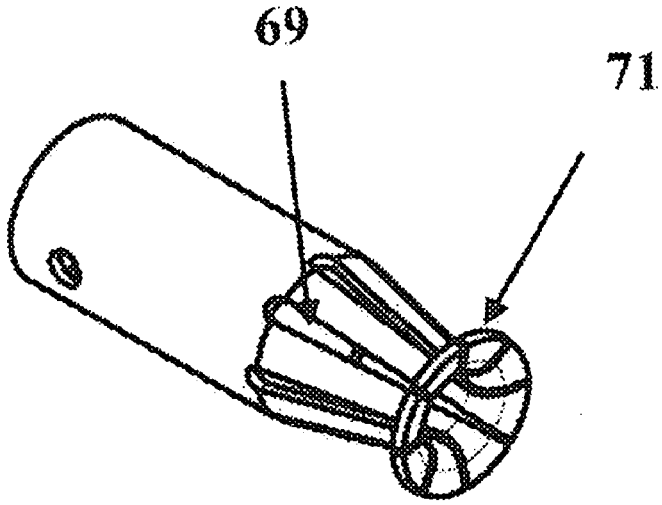
FIG. 11*b* shows a tube with slots and flanges that is inserted into a ball in accord with some aspects of the invention.

This is accomplished as shown in FIGS. 11*a* and 11*b* by drilling a hole 59 only partially through the ball 13, for example in the case of a baseball, a ⅞" diameter hole is drilled to a depth of 2 inches. Then a 1⅛" diameter, 0.08" long groove 67 is cut at the bottom of the blind hole, which creates a ⅛" wide, 0.08" deep shelf at the end of the blind hole. Then a series of vertical slots, 69 are cut in a flanged end of the tube that will be inserted into the hole in ball 13. Preferably, these are 8 1"-long by 1/16"-wide, and may be cut on a vertical mill using a 0.125" thick slitting saw having the core mounted in an indexing spacer head, or can be done in quantity by CNC machinery.

Now, at this point the slotted end of the tube is compressed symmetrically so that the flange outer edge defines a circular diameter slightly less than ⅞". The core tube is then inserted into the bored hole in the ball until the end of the slotted region 71 hits the end of the bored hole 59 and groove 67. Then an expander tube (not shown) whose outer diameter is slightly less than the core tube's inner diameter is driven into the core tube until it forces apart the slotted end of the core tube and thereby forces the flange into groove 67 at the end of the bore hole 59.

This arrangement now captures the ball internally without the necessity of fully penetrating the ball, but while still allowing the ball to rotate on the core tube as needed. This attachment method has the added benefits of ball durability under hitting conditions because the ball's outer surface and underlying core material integrity remain intact, and additionally the ball appears as a complete, unadulterated ball to the trainee.

Figure 12:
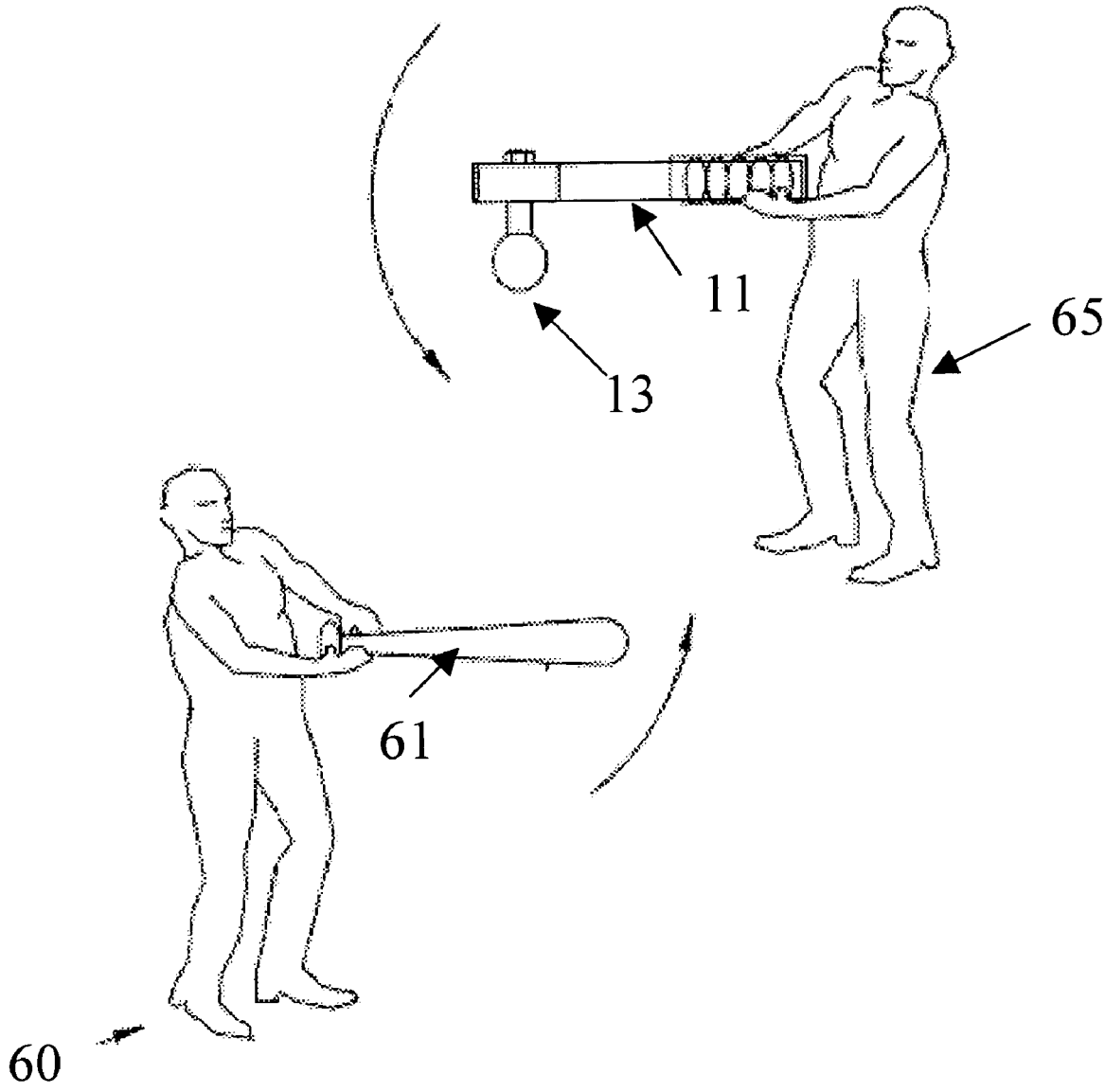
FIG. 12 shows a trainer and a trainee utilizing a device in accord with aspects of the invention.

A basic form of operation of the invention is shown in FIG. 12. A trainee, herein referred to as batter 60, stands in the customary position and posture for batting a ball. Batter 60 holds a bat 61 in a ready position. A trainer 65, stands approximately 5 to 6 feet from and facing batter 60, holding an embodiment of the invention. It is helpful to employ a position indicator, such as a home plate, on the ground, which may be fabricated from thin vinyl which tends to remain flat on the ground.

Trainer 65 is displaced about 3 feet forward and 5 feet to the side of batter 60, facing the home plate. These distances will vary from individual to individual, depending on size, batting style and other such factors. Trainer 65 holds apparatus 100 much in the manner of a baseball bat, but not fully retracted for a full back swing, with ball 13 oriented below rod 11. Trainer 65 may adopt a stance somewhat similar to a batter preparing to bunt a baseball. Trainer 65 then presents ball 13 to batter 60, using a motion that is similar to the motion of a person attempting to bunt a baseball. Thus, one hand is held at handle 14 while the other hand slides partway along rod 11, effectively moving ball 13 toward batter 60. The attitude and speed of presentation of ball 13, in both vertical and horizontal planes, can thus be completely controlled by trainer 65. For example, if batter 60 is a young child just learning to swing at a baseball, the ball can be presented very slowly and in a straight-on manner. Simultaneously with presenting ball 13 for batter 60 to swing at, trainer 65 will typically provide verbal instruction On the other hand, if batter 60 is more advanced, ball 13 can be presented at higher speed and from a variety of angles.

It has been found that some trainers prefer to hold rod 11 with only one hand, usually positioned about ¼ to ⅓ of the distance from the end of rod 11 proximate to the trainer. In this manner the trainer has a second hand free to reach out and touch the hitter, or to indicate positions or motions. However, after using the device in this manner for a period of time, the device would sometimes appear "heavy", and tire the arm of the trainer. The solution to this problem was not to make the device lighter, but rather to add some weight to the device. This is done in the form of the counterweight shown in FIG. 11, and serves to counter the torque generated by ball 13 and its associated attachment mechanism. For the form of counterweight shown, it is easy to calculate how much weight is needed to move the center of gravity of the device to any given point along rod 11. With the materials and dimensions shown, the center of gravity becomes located about halfway down the length of rod 11. Since the added weight is about equal to the combined weight of the ball and attachment mechanism, it was thought by most trainers that the addition of this weight would not relieve the "heaviness" of the device, but would exacerbate that problem. However, repeated testing has shown that the addition of the counterweight does indeed eliminate the apparent heaviness of the device for most people, indicating that the actual problem was the effect of torque on the wrist, than to the weight of the device.

For advanced practice, trainer 65 can move rod 11 toward trainee 60 at high speed, so that ball 13 will be presented to batter 60 at a very high velocity. Such a presentation was also possible with prior art devices, such as the device described in U.S. Pat. No. 6,435,989. However, it was preferable that regardless of the speed at which the ball was presented, still Trainee 60 would swing his bat in a relatively slow motion so as to meet the ball with only a little force. However, it was found that as trainees improved their eye-hand coordination, they usually desired to "swing away" when the ball was presented at a higher velocity, thereby simulating the pitching/hitting conditions in an actual game situation. In most cases the bat of the trainee would strike the ball "properly" with no adverse result. But in some cases, the bat would partially or wholly miss the ball and strike rod 11, in which case some damage could be done to rod 11 or to the apparatus that attached ball 13 to rod 11. Most often this damage was not sufficient to render the apparatus unusable, but still the cosmetic appearance would sometimes suffer. A strong trainee swinging at a fast-presented ball, but striking the region of the connecting mechanism could bend the connector to a lesser or greater degree, an undesirable result for a device which is intended for use over long periods of time. A device in accordance with the preferred embodiments of the present invention will withstand such blows without significant damage, and even generally without serious negative effects on the cosmetic appearance of the device.

An additional advantage of the present invention is that the training may be done in a process that programs the proper eye-hand coordination into the body's neuro-muscular system. In this mode of training, the trainer begins by presenting the ball slowly, and also instructs the batter to initially swing the bat in slow motion, the trainer correcting the batter's stance and motion with each presentation of the ball and concomitant swing. As the training progresses, the trainer presents the ball at increasing speeds. At each speed the trainee initially swings very slowly, and then gradually increases the speed of his swings, until finally swinging-away at the ball as he would in an actual game. Through this progression, the correct motions become locked into the neuro-muscular structure of the trainee's body.

Many variations in the use of apparatus 100 are possible. For example, as described above, a trainer 65 may choose to hold rod 11 and present ball 13 with only one hand, or with two hands on the rod. Trainer 65 may present ball 13 to batter 60 in a manner to emulate a curve ball, a sinker, or a fastball, all under complete control of trainer 65 since ball 13 is in essentially rigid connection to and under the control of trainer 65. Trainer 65 can vary the presentation of ball 13 to batter at will, providing maximum flexibility for trainer 65 to tailor the lesson to batter 60. This allows batter 60 to experience swinging at a ball numerous times in a very short training period since the only time between swings required is that necessary for batter 60 to reposition himself.

From the viewpoint of a coach, the use of the present invention provides essentially instantaneous feedback to the trainee by virtue of the ability to stop the action at any point, beginning with the presentation of the ball, through the contact of bat with ball, and through the completed full stroke of the batter. This instantaneous feedback can be used to allow for the frequent changes in presentation discussed above. Furthermore, it has been found that if the trainer holds rod 11 with a degree of flexibility, then after contact of the bat with the ball, the ball will move in a direction which indicates what would have been the nature of an actual hit, e.g. a line drive, grounder, pop-up, etc. The visual indication is quite striking and very useful from an instructional viewpoint. Further, training time is more efficiently used because the trainer does not lose possession of the ball and the ball does not have to be retrieved after the batter swings at it.

In an alternative but similar manner, the apparatus according to the present invention can be used to instruct young ball players to catch a ball in a glove by presenting ball 13 to trainee 60 in a manner to simulate a thrown or batted ball. Such a teaching method is contemplated by the present invention. In this application, the trainee 60 is provided with a glove, and the trainer with apparatus 100. The trainee 60 and trainer 65 position themselves apart so that the trainer 65 can move apparatus 100 in such a manner to simulate a thrown or batted ball, moving the ball in an appropriate arc from an away position to the trainee's glove. With new or young trainees, the trainer may move the ball slowly, describing to the trainee what is occurring and what the trainee should be doing at each moment. As the trainee becomes more proficient at catching the ball, trainer 65 may increase the speed at which ball 13 is presented to trainee 60. A known problem with teaching the concepts of fielding a ball in the conventional manner, in which a trainer tosses the ball at the trainee, who attempts to catch the ball, but often fails to do so, is that the trainee suffers not one, but two negative experiences. First, the trainee has failed to catch the ball, and second, the trainee must retrieve the missed ball before the training can continue. A coach who is sensitive to the damage that negative feedback can do to a young player will take special care to verbally assure the trainee in such a situation that progress is being made. Use of the present invention obviates this awkward situation in its entirety, because the trainer can control the presentation of the ball to insure that the trainee is able to catch it, and in no case does the trainee need to retrieve a loose ball.

Another advantage of the present invention has been found when the device is used by two trainees working as a pair, wherein one of the trainees plays the part of the trainer. In such an exercise, the "trainer" is compelled to pay strict attention to how he or she is presenting the ball (i.e. the "flight path" of the ball") which reinforces the lessons and muscle memories that he or she has learned as the hitter.

A version of the invention used for tennis allows the tennis instructor to emulate the approach of the ball as it hits the ground, then bounces up toward the trainee. By first moving the ball at very slow speed, and then more and more rapidly, while the trainee executes the approach, backswing and foreswing at correspondingly increasing speeds, the proper eye-hand coordination can be locked in to the body of the trainee. All of the various possibilities for the approach of the ball can be exercised, including top spin and under spin. The training of the player is thereby greatly facilitated.

The present invention has been particularly shown and described with respect to certain preferred embodiments of features thereof. However, it should be readily apparent to those of ordinary skill in the art that various changes and modifications in form and details may be made without departing from the spirit and scope of the invention as set forth in the appended claims.

The invention claimed is:

1. An apparatus for use by a trainer and a trainee in which, as part of a training exercise, the trainee strikes a designated part of the apparatus with a bat, the apparatus comprising:

a substantially rigid elongated rod having a distal end and a proximal end for holding by the trainer;

a spherical ball-like object positioned near the distal end of the elongated rod, having a bore-hole at least partially therethrough; and a robust connecting means for rigidly connecting the ball-like object to the elongated rod, at a substantially right angle to the elongated rod; said robust connecting means being constructed to withstand a high-velocity impact from a bat without deformation or damage to the apparatus, said robust connecting means including:

(i) a sleeve surrounding a portion of said elongated rod near the distal end of said elongated rod; said sleeve including a protruding neck portion extending at a 90 degree angle to said elongated rod;

(ii) a collar surrounding said protruding neck portion of said sleeve; and (iii) a cylinder passing through at least a portion of said borehole in said spherical ball-like object and said collar surrounding said neck portion, and being connected to said sleeve.

2. An apparatus for use by a trainer to train a trainee to strike a designated part of the apparatus with a bat, the apparatus comprising:

an elongated rod having a distal end and a proximal end for holding by the trainer;

a modified actual sport-ball positioned near the distal end of the elongated rod, said sport-ball having a bore hole therein, and connecting means for connecting the sport-ball to the elongated rod, at a substantially right angle to the elongated rod; said connecting means including a hollow cylinder having a diameter greater than 0.25 times the diameter of said sport-ball and passing through at least a portion of said sport-ball;

spacer means for positioning the sport-ball in spaced-apart relation from said elongated rod, said spacer means including a collar surrounding a portion of the hollow cylinder extending from the part of the sport-ball closest to the elongated rod.

3. An apparatus for use by a trainer to train a trainee to strike a designated part of the apparatus with a bat, the apparatus comprising:

an elongated rod having a distal end and a proximal end for holding by the trainer;

a spherical ball-like object positioned near the distal end of the elongated rod, having a bore hole extending partially therein and having no exit hole, thereby having the appearance of an unaltered actual sport-ball; said bore-hole terminating in a groove in said ball-like object, said groove having a diameter greater than the diameter of said borehole; and connecting means for connecting the ball-like object to the elongated rod at a substantially right angle to the elongated rod; said connecting means including a hollow cylinder passing through at least a portion of the bore-hole in the ball-like object, wherein the end of said cylinder that lies within said ball-like object is slotted and terminates in a flange having slotted fingers that extend into said groove.

4. Apparatus as in claim 2 wherein the connecting means includes clamping means for clamping around the rod, the clamping means also extending into a portion of the hollow cylinder.

* * * * *